US010582744B2

(12) United States Patent
Tannen

(10) Patent No.: US 10,582,744 B2
(45) Date of Patent: Mar. 10, 2020

(54) EARRING ENHANCERS—HIDE THE HOLES

(71) Applicant: Carol Tannen, Boca Raton, FL (US)

(72) Inventor: Carol Tannen, Boca Raton, FL (US)

( * ) Notice: Subject to any disclaimer, the term of this patent is extended or adjusted under 35 U.S.C. 154(b) by 208 days.

(21) Appl. No.: 15/896,259

(22) Filed: Feb. 14, 2018

(65) Prior Publication Data

US 2019/0246751 A1 Aug. 15, 2019

Related U.S. Application Data

(60) Provisional application No. 62/600,109, filed on Feb. 14, 2017.

(51) Int. Cl.
*A44C 7/00* (2006.01)

(52) U.S. Cl.
CPC ..... *A44C 7/002* (2013.01)

(58) Field of Classification Search
CPC ..... A44C 7/002; A44C 7/00; A44C 17/0208; A44C 17/0216; A44C 17/0258; A44C 13/00; A44D 2203/00
USPC ..... 63/13, 12, 26, 29.1, 29.2, 40, 900
See application file for complete search history.

(56) References Cited

U.S. PATENT DOCUMENTS 4,195,492 A * 4/1980 Johnson ..... A44C 7/002 63/11
4,783,974 A * 11/1988 Hernandez ..... A44C 7/002 63/1.16
5,203,183 A * 4/1993 Salerno ..... A44C 7/00 63/12
5,743,113 A * 4/1998 Kogen ..... A44C 7/003 63/12
7,329,020 B1 * 2/2008 Miller ..... A44C 7/00 362/104
8,621,887 B1 * 1/2014 Arlow ..... A44C 7/002 63/12
8,991,210 B1 * 3/2015 Stewart, Jr. ..... A44C 7/003 63/12
2007/0084240 A1 * 4/2007 Bruno ..... A44C 7/002 63/12
2009/0100865 A1 * 4/2009 Van Guelpen ..... A44C 7/00 63/1.11
2010/0147025 A1 * 6/2010 Simpson ..... A44C 15/0035 63/13
2012/0240623 A1 * 9/2012 Morse ..... A44C 7/002 63/13

* cited by examiner

*Primary Examiner* — Justin M Jonaitis

(57) ABSTRACT

This invention consists of a magnet placed behind the pierced ear hole and a decorative piece placed in front of the pierced ear hole, both strung on the wire of a hanging earring. The 2 pieces are slid into place on the wire and then pressed together once in position over the pierced hole. The magnet holds the decorative front in place. They are made to be used with any hanging type of wire earring that a person wants to wear. The front pieces can also be used alone with post earrings to make the ear lobe look more attractive.

1 Claim, 1 Drawing Sheet

EARRING ENHANCERS—HIDE THE HOLES

Figure 1:
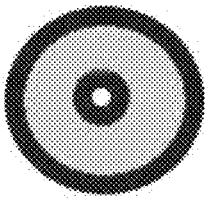
FIG. 1 shows the front view of the Neodymium 35 and Neodymium 42 magnets used in this invention.
Figure 2:
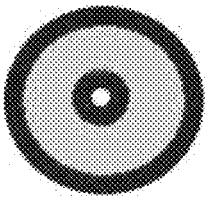
FIG. 2 shows the back view of the Neodymium 35 and Neodymium 42 magnets used in this invention.
Figure 3:
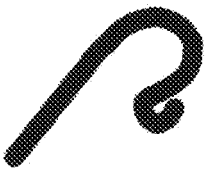
FIG. 3 shows a typical earring wire for a hanging earring that this invention is designed to use and enhance.
Figure 4:
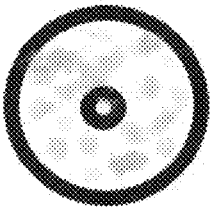
FIG. 4 shows a front view of a decorative piece that covers the pierced hole and makes the earring wire look more attractive at the earlobe. This is an example of a hammered/textured piece. It comes in many colors.
Figure 5:
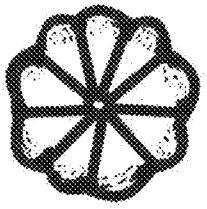
FIG. 5 shows a front view of a decorative piece that covers the pierced hole and makes the earring wire look more attractive at the earlobe. This is an example of a scalloped edge and ridged piece. It comes in many colors.
Figure 6:
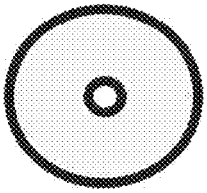
FIG. 6 shows a front view of a decorative piece that covers the pierced hole and makes the earring wire look more attractive at the earlobe. This is an example of a smooth round piece. It comes in many colors.
Figure 7:
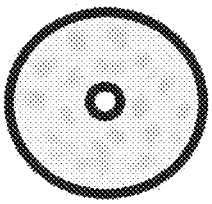
FIG. 7 shows the textured back of the decorative piece that goes in front of the earlobe. These backs can be either flat or textured.
Figure 8:
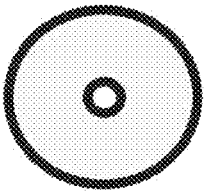
FIG. 8 shows the flat back of the decorative piece that goes in front of the earlobe. These backs can be either flat or textured.
Figure 9:
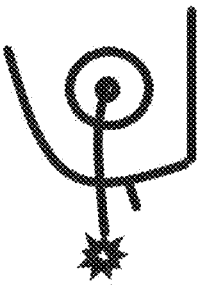
FIG. 9 shows a front view of an earring enhancer decorative front located on an actual wire going through a pierced ear hole on an actual earlobe.
Figure 10:
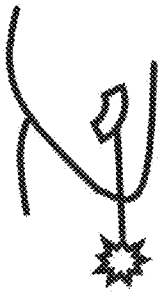
FIG. 10 shows a side view of an earring enhancer front located on an actual wire going through a pierced ear hole on an actual earlobe.
Figure 11:
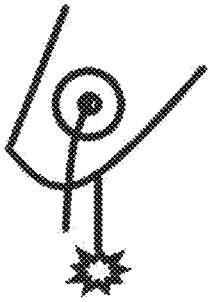
FIG. 11 shows a back view of the magnet located on an actual wire going through a pierced ear hole on an actual earlobe.

The present invention, EARRING ENHANCERS—Hide The Holes, will cover the pierced earring holes while supporting and enhancing the look of the earrings. They are made to be used with any hanging type of wire earring that a person wants to wear.

This invention consists of a combination of a magnet and a front decorative piece that both slip over the wire portion of an earring made for pierced ears. These wires include, but are not limited to: ear wires, hook ear wires, ear threads, fish hook ear wires. The front piece goes on the wire first, then the earring wire goes through the ear and the magnet is then slid up the back of the wire. When the magnet and the decorative front piece are pressed together from opposite sides of the ear, they stay in place and hide the pierced earring hole, while also adding a decorative touch to the earring. The decorative fronts come in a variety of styles, shapes and colors that enhance the look of the earring. Styles range from simple to more ornate. Shapes consist of a round circle with plain, scallopped or ridged edges. Colors include but are not limited to silver, antique silver, gold, antique gold, rose gold, copper, brass, gunmetal, black.

Directions to use this invention: First slide the decorative front ring onto the wire earring with the decorative side facing forward. Then put the earring wire through the pierced hole, with the decorative ring in front. Then slide the magnet onto the wire in the back of the ear and move it up to the earlobe. Line up the 2 pieces and press them together. The magnet will then hold the front ring securely in place.

The magnets utilized in this invention come in 2 strengths because some people have thicker ear lobes and may need a stronger magnet to hold the front in place better. The 2 strengths of magnets utilized are a Neodymium 35 magnet and a Neodymium 42 magnet. Both strength magnets are zinc plated and are 1/16 inch thick, 1/4 inch diameter round circles with a 1/16 inch hole in the center. Both strength magnets are made in 2 different colors: silver and gold. There may be different color magnets in the future.

The decorative front piece is approximately a 5/16 inch diameter round circle that is 1/32 inch thick with a 1/16 inch hole in the center. This decorative front piece is made out of a material that will stick to and be attracted to a magnet, including but not limited to iron or carbon steel. It is made in the following colors: silver, antique silver, gold, rose gold, antique gold, copper, brass, gunmetal, black. There may be additional colors added in the future. There may be more decorative front designs in the future.

The front piece of this earring enhancer can also be used alone on the front of a post earring to make the earring look more decorative and attractive.

BACKGROUND

There are many people who hesitate to wear wire hanging earrings because their pierced holes have stretched or they feel that the look of the plain wire is not very attractive. Earring Enhancers are designed to eliminate both problems. The decorative fronts are large enough to cover the pierced hole and are attractive so they enhance the overall look of the earring. They come in a variety of colors to match different colored earrings. They also come in a variety of designs that range from simple to dressier for any occasion. The magnet in back holds the front securely in place.

SUMMARY

This invention provides a solution to stretched pierced ear holes and to earrings that don't look attractive with just a plain wire at the ear lobe. The design of a magnet in combination with a decorative front piece is a unique way to solve this problem. It makes hanging wire earrings more attractive and allows the wearer freedom to move about as usual without worrying about losing an earring. The magnet holds the decorative front in place against the ear lobe, while the wire and anything hanging from it can move freely as usual.

This invention can also work with post earrings by placing just the decorative front on the post in front of the hole.

The invention claimed is:

1. An earring addition for a hanging style earring including a wire comprising:

a) a decorative piece made of a ferrous metal intended to be placed on the hanging style earring wire and placed against a front of a pierced hole of an ear lobe, the decorative piece covering and hiding and supporting the pierced hole and also enhancing the look of the earring itself;

b) a magnet formed from Neodymium 35 or Neodymium 42 or a material with a magnetic strength of approximately Neodymium 35 or Neodymium 42 intended to be placed against a back of the pierced hole of an ear lobe whereby that magnet is pressed together with the decorative piece to maintain the decorative piece in a stable position and keep the decorative piece from falling forward off the ear lobe, wherein the pressure of the magnet and the decorative being pressed together by magnetic attraction also provides support to help protect the pierced hole from stretching;

c) the wire from the hanging earring that will go through the pierced hole in the ear and facilitates holding both the decorative front piece and the magnet in place on the ear lobe.

* * * * *